US007393079B2

(12) United States Patent
Ahne et al.

(10) Patent No.: US 7,393,079 B2
(45) Date of Patent: Jul. 1, 2008

(54) INK JET PRINTHEAD GARAGE CONFIGURED TO PERFORM MAINTENANCE FUNCTIONS

(75) Inventors: Adam Jude Ahne, Lexington, KY (US); Jeffery James Buchanan, Lexington, KY (US); Curtis Ray Droege, Richmond, KY (US); Sam Norasak, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 385 days.

(21) Appl. No.: 11/017,996

(22) Filed: Dec. 21, 2004

(65) Prior Publication Data

US 2006/0132534 A1 Jun. 22, 2006

(51) Int. Cl.
*B41J 2/165* (2006.01)

(52) U.S. Cl. ..... 347/22; 347/29

(58) Field of Classification Search ..... 347/22, 347/29–31, 33–34, 49, 50, 84–87, 92, 108
See application file for complete search history.

(56) References Cited

U.S. PATENT DOCUMENTS 4,437,105 A 3/1984 Mrazek et al.
5,438,351 A 8/1995 Trenchard et al.
5,621,450 A 4/1997 Kawai et al.
5,805,181 A 9/1998 Tanaka et al.
5,926,196 A 7/1999 Sawicki et al.
6,039,431 A 3/2000 Yui et al.
6,042,216 A 3/2000 Garcia et al.
6,097,407 A * 8/2000 Terasawa et al. ..... 347/31
6,120,128 A 9/2000 Kawakami et al.
6,173,128 B1 * 1/2001 Saber et al. ..... 399/24
6,247,598 B1 * 6/2001 Hosaka et al. ..... 206/723
6,799,842 B2 * 10/2004 Barinaga et al. ..... 347/85
2002/0175970 A1 * 11/2002 Arai et al. ..... 347/33

* cited by examiner

*Primary Examiner*—Juanita D Stephens
(74) *Attorney, Agent, or Firm*—Taylor & Aust, PC

(57) ABSTRACT

A printhead garage for receiving an ink jet printhead cartridge includes a chassis defining an opening for receiving the ink jet printhead cartridge when the ink jet printhead cartridge is not installed for use by the imaging apparatus for printing. A maintenance assembly is coupled to the chassis and configured to perform at least one printhead maintenance operation. In one embodiment, a printhead firing unit is coupled to the chassis.

29 Claims, 6 Drawing Sheets

INK JET PRINTHEAD GARAGE CONFIGURED TO PERFORM MAINTENANCE FUNCTIONS

BACKGROUND OF THE INVENTION

1. Field of the Invention

The present invention relates to printhead maintenance, and, more particularly, to an ink jet printhead garage configured to perform maintenance functions.

2. Description of the Related Art

An imaging apparatus, such as an ink jet printer, includes an ink jet printhead having a plurality of ink jetting nozzles formed in a nozzle plate. The ink jet printhead may be attached, for example, to a printhead cartridge having an integral ink reservoir. The ink jet printer includes a maintenance station that performs maintenance operations to preserve the life of the associated printhead.

Such a maintenance station for an ink jet printer typically includes a printhead wiper and a printhead capping mechanism for performing a printhead wiping operation and a printhead capping operation, respectively, in the ink jet printer. In addition, other maintenance operations may be performed by the printer, such as for example, a printhead spit operation, wherein the ink jetting nozzles are fired, such as for example, after wiping and prior to capping. Also, some ink jet printers may include a vacuum device for performing a printhead priming and suction operation. In such instances, for printhead maintenance to be performed, the printhead is installed in the printer, and more particularly, in the reciprocating carrier of the printer.

Early ink jet printers were often referred to as "head swapping" ink jet printers due to the requirement of exchanging a monochrome printhead cartridge and a color printhead cartridge during print jobs that included both color and monochrome print areas. Thus, there has been a need for a device to store the uninstalled printhead in a way that it could be used again in the future. Early attempts at preserving the uninstalled printhead cartridge include a simple printhead garage having capping only functionality, and used to cap the nozzle plate of the printhead cartridge, in order to attempt to prevent the drying out and clogging of the nozzles of the uninstalled printhead cartridge during periods of disuse. However, such a garage may not be adequate to accommodate the demands of current printing practice.

Current ink jet printers typically support photo printing, e.g., six color printing, in addition to normal printing. With such printers, a user may have, for example, three printhead cartridges, e.g., a color cartridge, a monochrome cartridge, and a photo cartridge, of which only two cartridges are installed in the ink jet printer at any one time, while the third cartridge is removed. Thus, a need still exists for a device for preserving the uninstalled printhead cartridge in proper working order.

SUMMARY OF THE INVENTION

The present invention provides to an ink jet printhead garage configured to perform maintenance functions on an uninstalled printhead, such as a printhead of an ink jet printhead cartridge.

The invention, in one exemplary embodiment, is directed to a printhead garage for receiving an ink jet printhead cartridge when the ink jet printhead cartridge is not installed for use by an imaging apparatus for printing. The ink jet printhead cartridge includes a printhead having a plurality of nozzles and a plurality of ink jetting devices. The printhead garage includes a chassis defining an opening for receiving the ink jet printhead cartridge when the ink jet printhead cartridge is not installed for use by the imaging apparatus for printing. A maintenance assembly is coupled to the chassis and configured to perform at least one printhead maintenance operation. A printhead firing unit is coupled to the chassis. The printhead firing unit is electrically connected to the printhead to electrically exercise the plurality of ink jetting devices.

The invention, in another exemplary embodiment, is directed to a printhead garage for receiving an ink jet printhead cartridge when the ink jet printhead cartridge is not installed for use by an imaging apparatus for printing. The ink jet printhead cartridge includes a printhead having a plurality of nozzles and a plurality of ink jetting devices. The printhead garage includes a chassis defining an opening for receiving the ink jet printhead cartridge when the ink jet printhead cartridge is not installed for use by the imaging apparatus for printing. A maintenance assembly mounts a printhead capping unit and a printhead wiping unit. The printhead capping unit has at least one printhead cap and the printhead wiping unit has at least one printhead wiper. An actuator mechanism is coupled between the maintenance assembly and a user actuated operator. When a user applies a force to the user actuated operator, an action of the actuator mechanism is transferred to the maintenance assembly to cause the maintenance assembly to proceed through a predefined printhead maintenance sequence.

The invention, in still another exemplary embodiment, is directed to a printhead garage that includes a chassis defining an opening for receiving an ink jet printhead cartridge including a printhead having a plurality of nozzles. The opening is configured such that the ink jet printhead cartridge is received with the plurality of nozzles of the printhead in a vertical up position.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
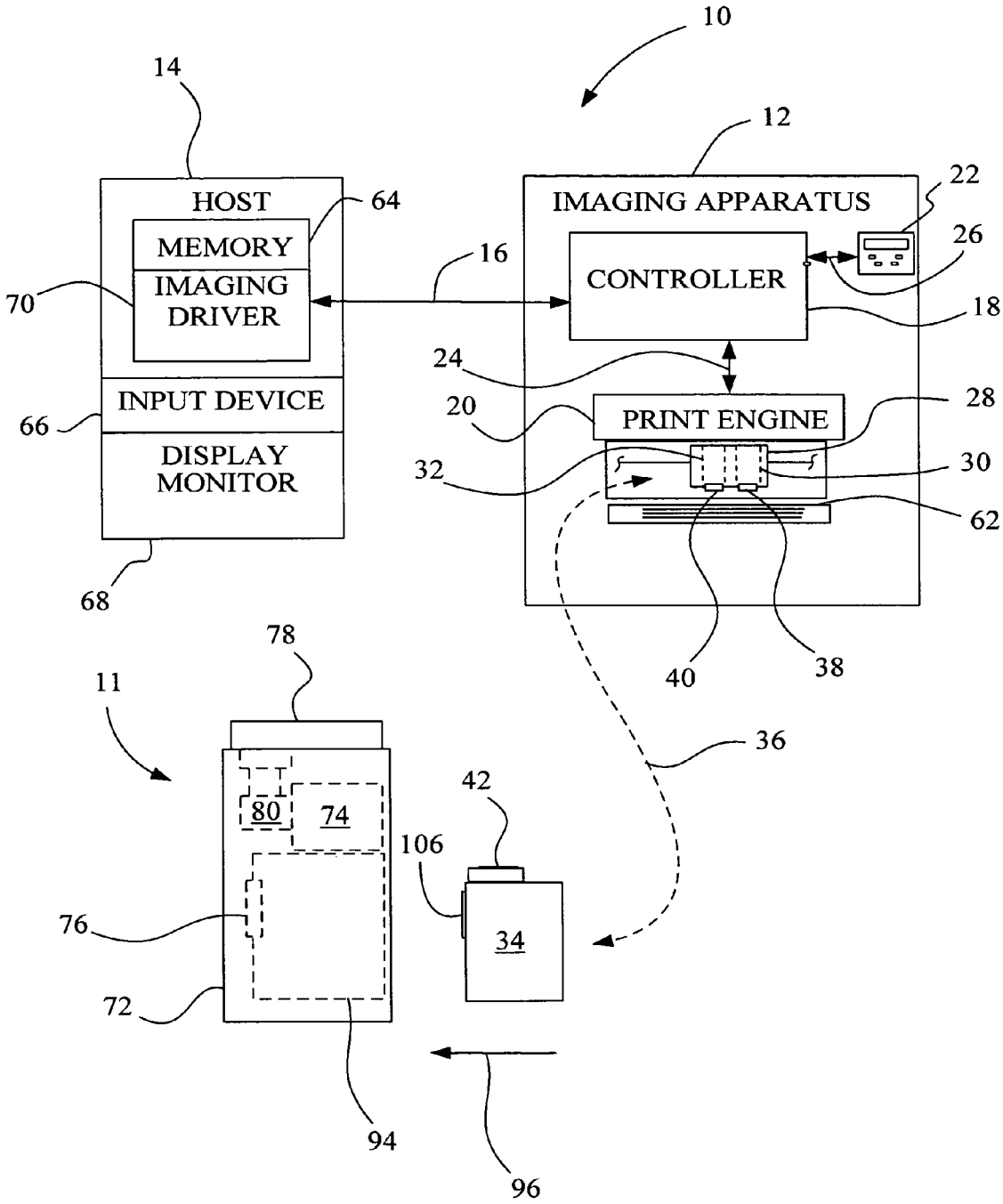
FIG. 1 is a diagrammatic depiction of an imaging system including the present invention.

Referring now to the drawings, and particularly to FIG. 1, there is shown a diagrammatic depiction of an imaging system 10, and a printhead garage 11 in accordance with the present invention.

Imaging system 10 includes an imaging apparatus 12 and a host 14. Imaging apparatus 12 communicates with host 14 via a communications link 16. Imaging apparatus 12 may be, for example, an ink jet printer and/or copier, or an all-in-one (AIO) unit that includes a printer, a scanner, and possibly a fax unit. Imaging apparatus 12 may include, for example, a controller 18, an ink jet print engine 20, and a user interface 22.

Controller 18 includes a processor unit and associated memory, and may be formed as one or more Application Specific Integrated Circuits (ASIC). Controller 18 serves a printer controller, and may alternatively be a scanner controller, or combined printer and scanner controller. Controller 18 is communicatively coupled to print engine 20 via a communications link 24, and to user interface 22 via a communications link 26. Controller 18 serves to process print data and to operate print engine 20 to perform printing.

Ink jet print engine 20 includes a reciprocating printhead carrier 28 configured to mount at least two of a plurality of printhead cartridges, such as for example, a color printhead cartridge 30, a photo printhead cartridge 32 and a monochrome, e.g., black, printhead cartridge 34. Color printhead cartridge 30 may contain full strength cyan (C), magenta (M) and yellow (Y) inks, and photo printhead cartridge 32 may contain diluted cyan (c) and dilute magenta (m), and full strength black (K) ink, so that in combination six-color printing may be realized with imaging apparatus 12. Accordingly, photo printhead cartridge 32 and monochrome printhead cartridge 34 may be swapped in and out of printhead carrier 28, as indicated by dashed line 36. For example, four-color printing is accommodated when color printhead cartridge 30 and monochrome printhead cartridge 34 are mounted in printhead carrier 28, and six-color printing is accommodated when color printhead cartridge 30 and photo printhead cartridge 32 are mounted in printhead carrier 28.

Figure 2:
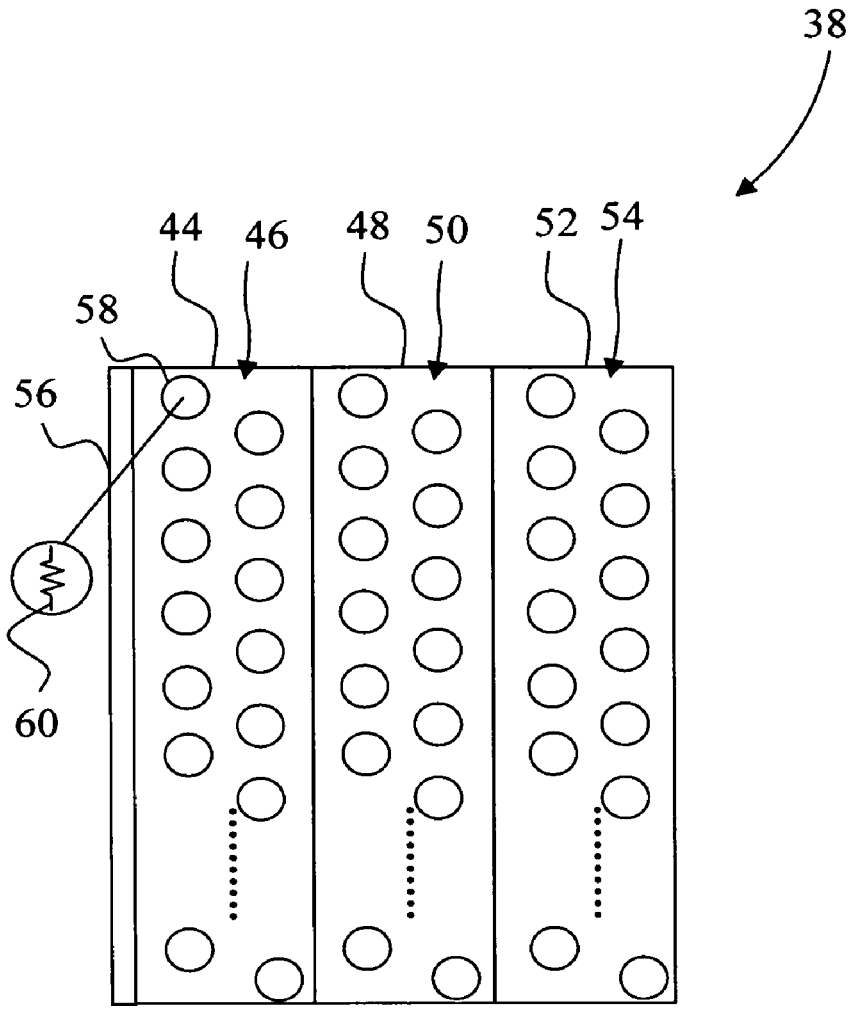
FIG. 2 is a diagrammatic depiction of an exemplary color printhead.

Color printhead cartridge 30 includes a color printhead 38, photo printhead cartridge 32 includes a color printhead 40 and monochrome printhead cartridge 34 includes a mono printhead 42. Each of printheads 38, 40, and 42 include a plurality of nozzles configured for ejecting ink. For example, FIG. 2 shows one exemplary configuration of an ink jet printhead, such as color printhead 38, which includes a cyan nozzle plate 44 including a nozzle array 46, a yellow nozzle plate 48 including a nozzle array 50, and a magenta nozzle plate 52 including a nozzle array 54, for respectively ejecting cyan (C) ink, yellow (Y) ink, and magenta (M) ink. In addition, printhead 38 may include a electronics module 56. Electronics module 56 may include a memory, and in some embodiments, may further include a rudimentary printhead driver. Electronics module 56 may be formed integral with color printhead 38, or may be attached to color printhead cartridge 30.

In the exemplary nozzle configuration for color printhead 38 shown in FIG. 2, each of nozzle arrays 46, 50 and 54 include a plurality of ink jetting nozzles 58, with each ink jetting nozzle 58 having at least one corresponding ink jetting device 60, e.g., heating element or piezoelectric element. The ink jetting nozzles are arranged in two columns in each of arrays 46, 50 and 54. An ink feed via (not shown) is used to supply ink to each of the ink jetting nozzles 58 of a particular array. Each of photo printhead 40 and monochrome printhead 42 may include a nozzle array configuration similar to that of color printhead 38, and will also include the plurality of ink jetting nozzles 58 and ink jetting devices 60.

Referring again to FIG. 1, as shown, ink jet print engine 20 selectively energizes the ink jetting devices 60 of color printhead cartridge 30 and photo printhead cartridge 32 to eject ink droplets onto a sheet of print media 62 in order to reproduce text or images, etc. The sheet of print media 62 may be, for example, a sheet of plain paper, photo paper, coated paper, transparency stock, etc.

Host 14 may be, for example, a personal computer, including memory 64, an input device 66, such as a keyboard, and a display monitor 68. Host 14 further includes a processor, input/output (I/O) interfaces, and at least one mass data storage device, such as a hard drive, a CD-ROM and/or a DVD unit. Memory 64 may be, for example, RAM, ROM, and/or NVRAM. During operation, host 14 includes in its memory a software program including program instructions that function as an imaging driver 70, e.g., printer driver software, for imaging apparatus 12. Imaging driver 70 is in communication with controller 18 of imaging apparatus 12 via communications link 16. Imaging driver 70 facilitates communication between imaging apparatus 12 and host 14, and may provide formatted print data to imaging apparatus 12, and more particularly, to print engine 20. Although imaging driver 70 is described as residing in host 14, alternatively, all or a portion of imaging driver 70 may be located in controller 18 of imaging apparatus 12, such as for example, in a firmware component of controller 18.

In accordance with the present invention, printhead garage 11 is provided for receiving an ink jet printhead cartridge, such as one of color printhead cartridge 30, photo printhead cartridge 32 and monochrome printhead cartridge 34 when the ink jet printhead cartridge is not installed for use by imaging apparatus 12 for printing, e.g., is not installed in printhead carrier 28. In the examples that follow, specific reference will be made to monochrome printhead cartridge 34, but those skilled in the art will recognize that the principles of the present invention may be applied to color printhead cartridge 30, photo printhead cartridge 32, or any other cartridge or printhead holding device.

Also, in the examples that follow it is assumed that printhead cartridge 34 has been removed from reciprocating printhead carrier 28 of imaging apparatus 12. Alternatively, however, the principles of the invention will apply where printhead cartridge 34 is a new printhead cartridge that has been removed from the factory packaging.

Figure 3:
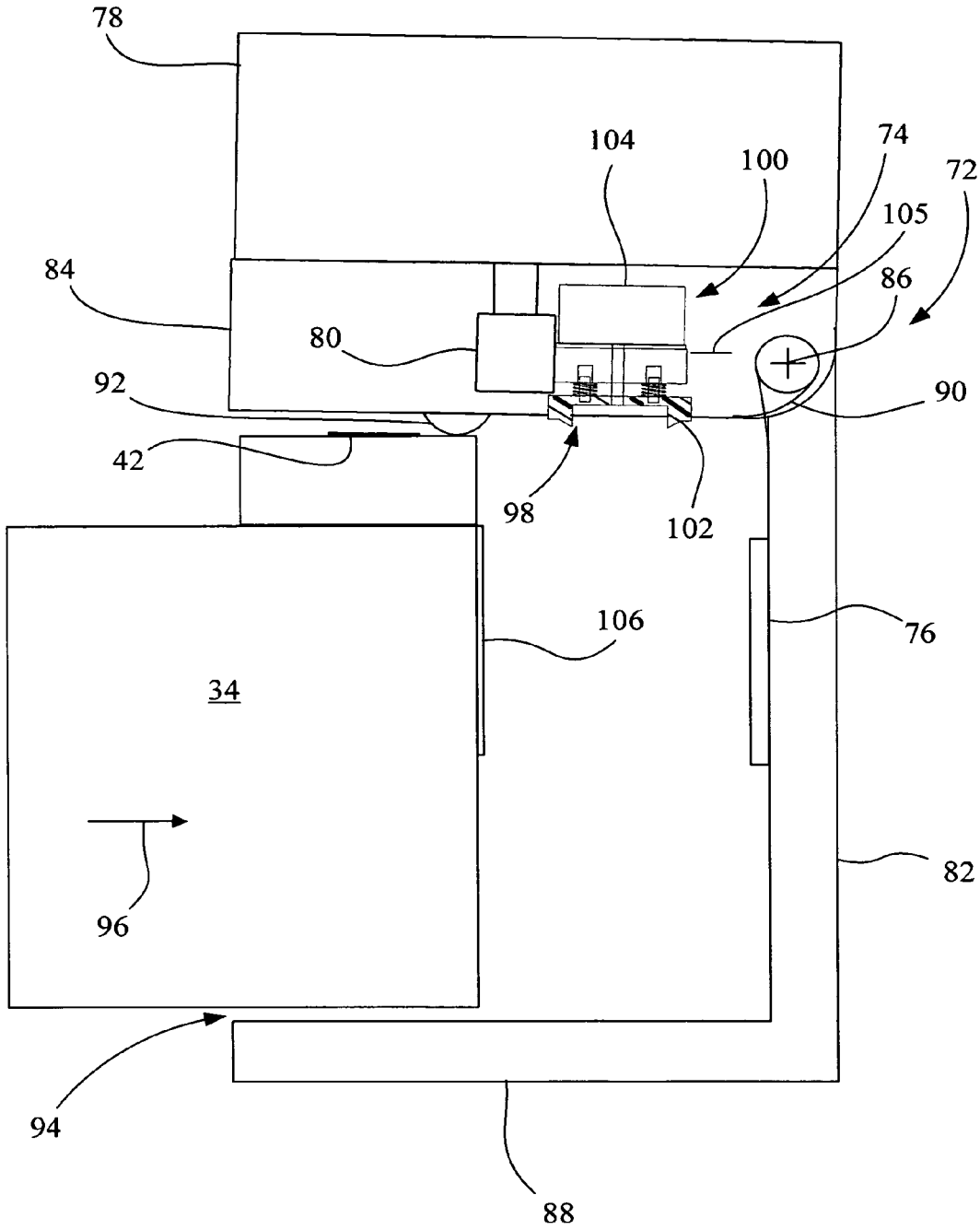
FIG. 3 is a diagrammatic side view of a portion of an embodiment of the printhead garage of FIG. 1.
Figure 4:
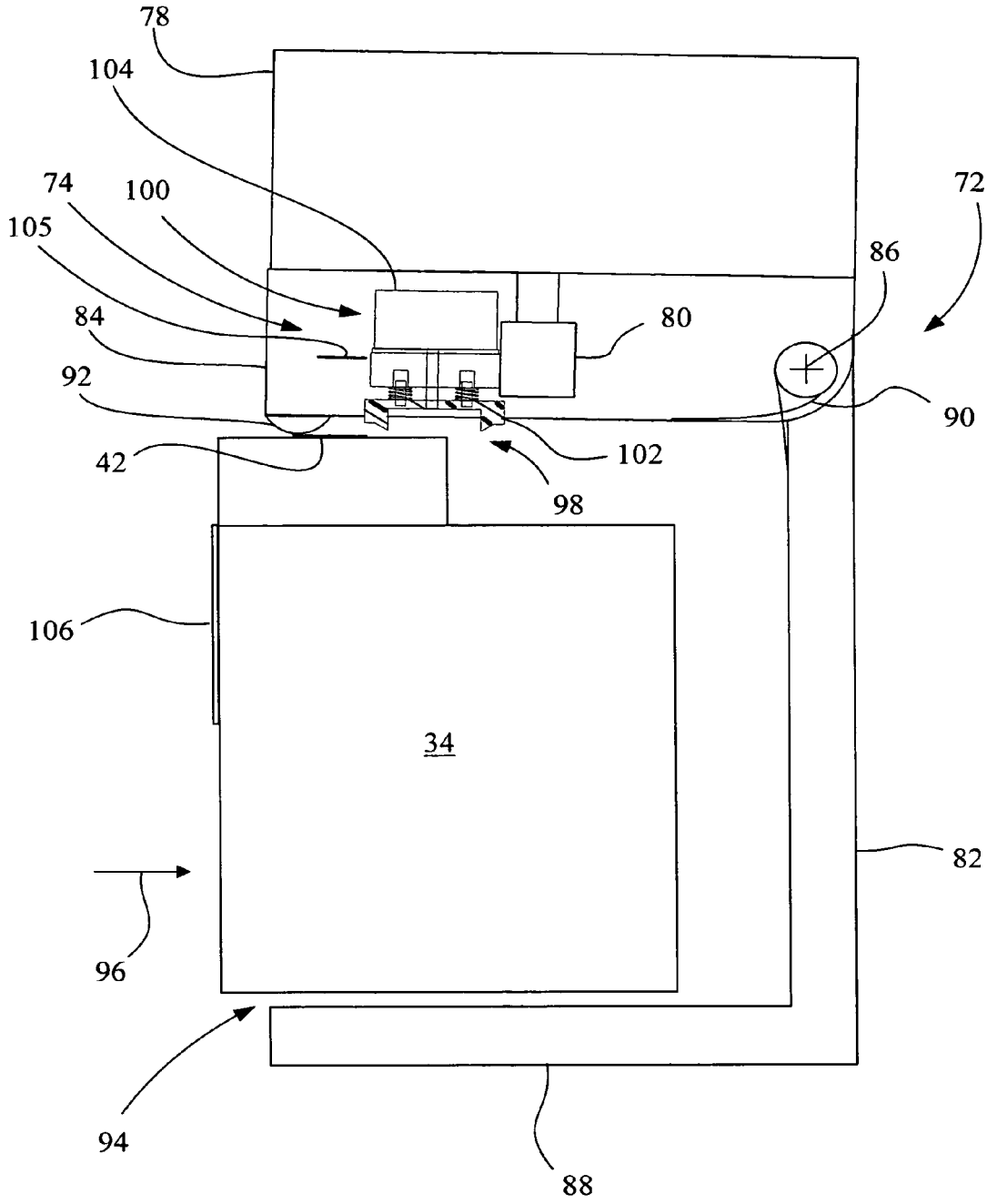
FIG. 4 is a diagrammatic side view of a portion of another embodiment of the printhead garage of FIG. 1.

As shown in FIGS. 1 and 3, printhead garage 11 may include a chassis 72, a maintenance assembly 74, a printhead firing unit 76 (which may be optional in some embodiments), a user actuated operator 78 and an actuator mechanism 80. Not shown in FIGS. 1 and 3 is a priming unit, e.g., a vacuum purge unit, which may be optional in some embodiments, and a waste ink accumulator, such as an ink absorption pad. The embodiment of FIG. 4 is similar to the embodiment of FIG. 3, in that it includes a chassis 72, a maintenance assembly 74, a user actuated operator 78 and an actuator mechanism 80, but differs in that it does not include printhead firing unit 76.

Referring to FIG. 3, chassis 72 includes a body 82 and a maintenance assembly holder 84. Maintenance assembly holder 84 is pivotally coupled to body 82 at a pivot axis 86, and is biased toward a base 88 of body 82 by a spring member 90. A cam 92 is provided on maintenance assembly holder 84 to engage the printhead cartridge (in this example monochrome printhead cartridge 34) so as to raise maintenance assembly holder 84 as the printhead cartridge is being inserted into an opening 94 defined by chassis 72.

The position of cam 92 with respect to maintenance assembly holder 84, as shown in FIG. 3, is exemplary, and may be positioned at other locations, as desired. For example, the embodiment of FIG. 4 positions cam 92 more toward the entrance of opening 94, so as to accommodate an alternate orientation of printhead cartridge 34, as shown. Printhead cartridge 34 is received in opening 94 of chassis 72 in the direction of arrow 96.

Chassis 72 is configured such that printhead cartridge 34 is received in opening 94 oriented with its plurality of nozzles 58 of printhead 42 in a vertical up position. In contrast, as shown in FIG. 1, when a printhead cartridge is mounted in printhead carrier 28 (see, for example, color printhead cartridge 30 having color printhead 38), the plurality of nozzles 58 of the printhead, e.g., printhead 38, are in a vertical down position.

Referring again to FIG. 3, maintenance assembly 74 is shown coupled to chassis 72. Maintenance assembly 74 mounts a printhead capping unit 98 and a printhead wiping unit 100. In the embodiment shown, printhead capping unit 98 has a printhead cap 102, and printhead wiping unit 100 has a printhead wiper 104 positioned, for example, at about 180 degrees from printhead cap 102 in this example. Each of printhead cap 102 and printhead wiper 104 may be made from an elastomeric material. Chassis 72 and maintenance assembly 74 may be configured, for example, such that when printhead cartridge 34 is received in opening 94 of garage 11, printhead 42 is capped by printhead cap 102 of printhead capping unit 98 automatically without actuation of actuator mechanism 80 via user actuated operator 78.

Thus, printhead cap 102 is in a "normally capped" position when printhead cartridge 34 is inserted into the printhead garage 11. For example, with printhead cartridge 34 fully inserted in opening 94, and printhead cartridge 34 is no longer engaged by cam 92, and a compression force is applied to printhead cap 102, such as for example, by way of maintenance assembly holder 84 and spring member 90 to cap printhead 42. Spring member 90 may be, for example, a torsion spring.

Actuator mechanism 80 is coupled between maintenance assembly 74 and user actuated operator 78. When a user applies a force to user actuated operator 78, an action, such as a rotary action, of actuator mechanism 80 is translated to maintenance assembly 74 to cause maintenance assembly 74 to proceed through a predefined printhead maintenance sequence. Such a rotary action may be, for example, a rotational action wherein the positions of printhead cap 102 and printhead wiper 104 are changed about a rotational axis 105. Also, such a rotary action may be, for example, a toggle action, wherein the positions of printhead cap 102 and printhead wiper 104 are changed by a combination of rotational action and linear action, wherein the rotational action may, for example, trace a somewhat elliptical path about axis 105, and the linear action may, for example, be substantially vertical.

The use of rotary action permits a compact arrangement of maintenance assembly 74. However, where space is not a primary concern, maintenance assembly 74 may take on a configuration that uses a linear action, which may, for example, be vertical or other orientation, as desired.

Referring to FIGS. 1 and 3, printhead firing unit 76 is coupled to chassis 72, and is located to engage a tape automated bonded (TAB) circuit 106 when printhead cartridge 34 is received in opening 94 of printhead garage 11. The engagement of printhead firing unit 76 with TAB circuit 106 of printhead cartridge 34 causes printhead firing unit 76 to be electrically connected to printhead 42, so as permit the selective electrically exercising of the plurality of ink jetting devices 60, such as during a printhead spit operation.

Printhead firing unit 76 may include, for example, printhead driver circuitry and a preprogrammed spit sequence of spit firing instructions to selective fire ink jetting devices 60 in a predefined sequence, or collectively fire combinations or all of the ink jetting devices 60 simultaneously, to eject ink from corresponding ink jetting nozzles 58 during a spit operation. Printhead firing unit 76 may include high current driver integrated circuits for NMOS printheads and/or low current logic buffers for CMOS printheads. Since maintaining exact ink drop velocity is not critical to the spit operation associated with printhead garage 11, printhead firing unit 76 may be design without the need to provide exact ink drop velocities, and may be designed to apply simple single fire pulses, as opposed to applying more complex pulse trains, e.g., including a pre-fire pulse, if desired.

The average current drawn by printhead 42 may be monitored by printhead firing unit 76 to detect faults within printhead 42. For example, if the average current exceeds a predefined value the power to printhead 42 is shut off and the user is notified of a fault, such as by an indicator light on chassis 72. The current may be monitored before, after, and/or during the spit operation.

Some printheads, such as printhead 42, may include a memory, such as the electronics module 56 shown in FIG. 2, to record the total number of drops ejected or the ink remaining in the printhead. Printhead firing unit 76 may include logic to address this memory and update the total drop counts stored in the memory to account for the ink lost in a spit operation.

As an alternative to providing firing logic in printhead firing unit 76, the preprogrammed printhead driver circuitry and/or the preprogrammed spit sequence may be resident in the electronics module of the printhead (see electronics module 56 of FIG. 2), wherein printhead firing unit 76 serves to provide control signals to the electronics module of printhead 42 to initiate the spit operation. This arrangement removes the need for logic in the printhead firing unit 76 for controlling the firing operation, and will reduce the number of electrical contacts between the printhead and printhead garage 11.

In one full service embodiment, for example, the predefined printhead maintenance sequence may include the operations of uncapping, priming, wiping, reverse wiping, spitting and recapping printhead 42. Thus, in this embodiment, printhead garage 11 integrates full maintenance functionality into a compact printhead storage apparatus to extend the life of the printhead. A downward motion of user actuated operator 78 will set in motion all or a portion of the predefined printhead maintenance sequence, as the customer deems necessary, depending, for example, on the extent of the motion of user actuated operator 78.

Figure 5:
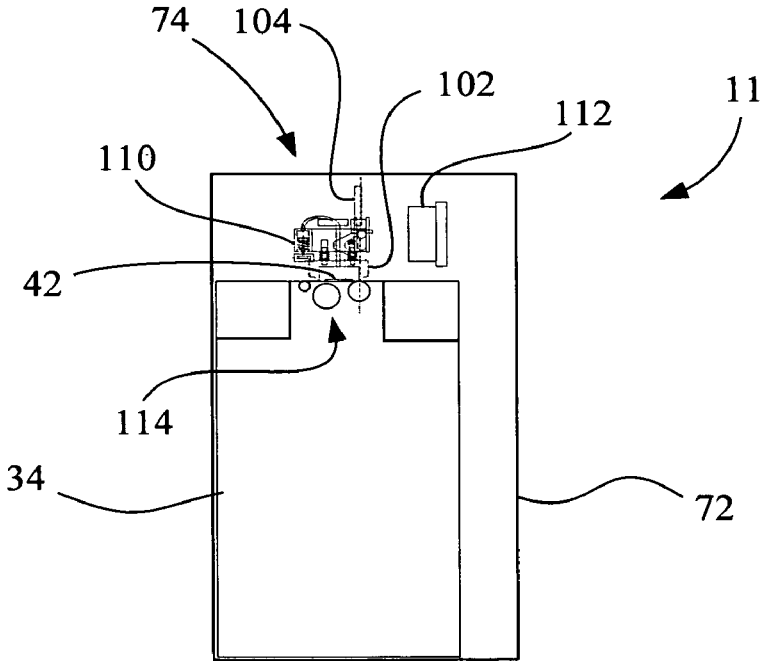
FIG. 5 illustrates the accumulation of air bubbles near the printhead when the printhead cartridge is installed in the printhead garage in a vertical up orientation.

FIG. 5 shows a diagrammatic front view of printhead garage 11, showing printhead cartridge 34 and printhead 42 in the vertical up position, and showing additional details of maintenance assembly 74. As shown in FIG. 5, maintenance assembly 74 further includes a vacuum purge unit 110, and a wet wipe pad 112 positioned in the proximity of printhead wiper 104. Wet wipe pad 112 may be, for example, a felt pad saturated in a low volatile solution capable of solubilizing dried ink. During operation, printhead wiper 104 comes in contact with wet wipe pad 112 to transfer the solution to printhead 42. As an alternative to wet wipe pad 112, a spray jetting device (not shown) may be used to spray the nozzle surface of printhead 42 with a solution prior to wiping.

As shown in FIG. 5, the vertical up orientation of printhead 42 of printhead cartridge 34 allows air bubbles 114, represented by circles, to migrate toward ink jetting nozzles 58 of printhead 42. Accordingly, printhead garage 11 is configured such that vacuum priming occurs with printhead 42 in an optimum vertical up position, such that air bubbles in printhead cartridge 34 and/or printhead 42 are readily collected during the priming operation.

Figure 6:
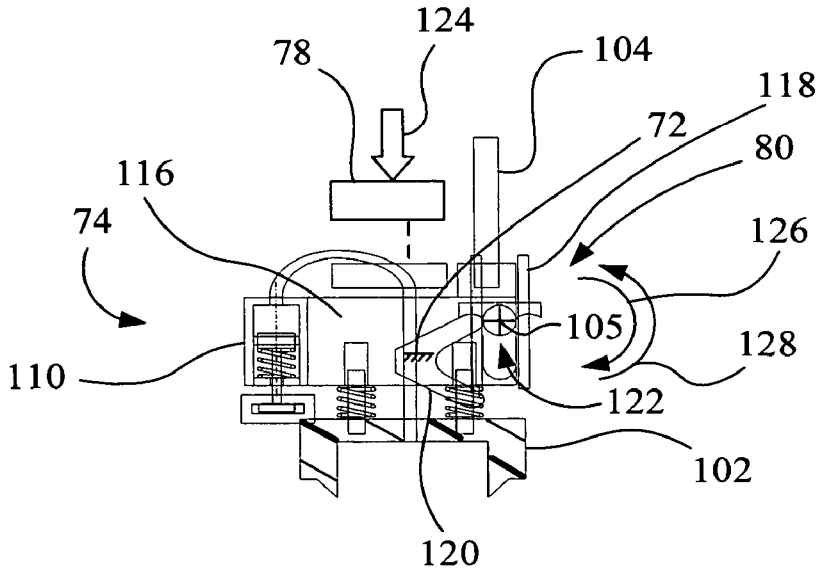
FIG. 6 is a diagrammatic depiction of the maintenance assembly of the printhead garage.

As shown in FIG. 6, maintenance assembly 74 includes a housing 116, a guide frame 118, a toggle cam 120, a pin and cam arrangement 122. Housing 116 is connected to chassis 72 of printhead garage 11. Guide frame 118, toggle cam 120, and pin and cam arrangement 122 cooperate to effect the toggle action embodiment of maintenance assembly 74 when a downward motion of user actuated operator 78 is applied in direction 124.

With the downward motion of user actuated operator 78, a rotational change of position of printhead cap 102 and printhead wiper 104 occurs as represented by rotational direction arrow with respect to rotational axis 105. When user actuated operator 78 is released, a reverse rotational change of position of printhead cap 102 and printhead wiper 104 occurs as represented by rotational direction arrow 128. In this embodiment, the rotary motion is provided by the relationship of toggle cam 120 and the pin and cam arrangement 122.

As the user actuated operator 78 moves downward, in direction 124, toggle cam 120 strikes the top of the pin of the pin and cam arrangement 122. Since the force is not in-line with the pin, maintenance assembly 74 mounting printhead cap 102 and printhead wiper 104 rotates in direction 126. The rotation is provided by a fork-shaped feature in toggle cam 120, which receives the cam of the pin and cam arrangement 122. The cam of the pin and cam arrangement 122 strikes the bottom of toggle cam at about 90 degrees, thus encouraging the last 90 degrees of rotation. The vertical pivot line of maintenance assembly 74 with respect to rotational axis 105 is outboard of the interior profile of printhead cap 102. The position of printhead wiper 104 is offset from rotational axis 105 of maintenance assembly 74 as well. Since printhead wiper 104 must wipe past the entire nozzle plate area of printhead 42, offsetting printhead wiper 104 reduces the required angular displacement, and can reduce the overall width of housing 116 to no more than what is required for printhead cap 102. In the case of the present example, 180 degrees is needed to complete the cycle.

Vacuum purge unit 110 is fluidically coupled to printhead cap 102. Vacuum purge unit 110 may be, for example, a spring and plunger system, wherein the plunger expands an air volume near the beginning of the maintenance cycle. A vent is provided that is normally open, but closed by the plunger during the priming operation of the maintenance cycle. Alternately, a separate priming station may be employed that would be independent of printhead cap 102.

Figure 7:
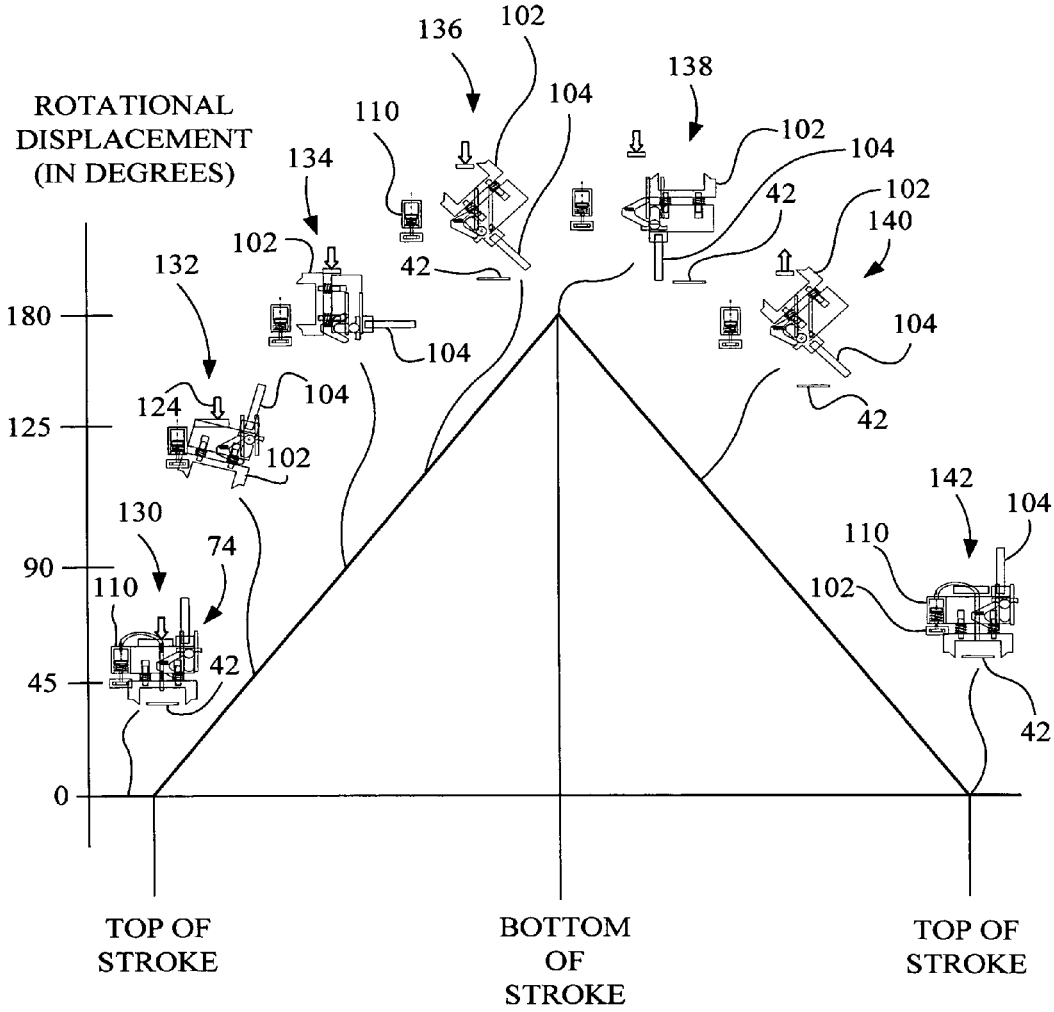
FIG. 7 is a displacement-function diagram provided to aid in understanding the mechanical action of the maintenance assembly.

FIG. 7 is a displacement-function diagram provided to aid in understanding the mechanical action of maintenance assembly 74. Discrete positions of maintenance assembly 74 are shown pictorially in pictorials 130-142. It is assumed that at the top of the stroke of user actuated operator 78 (not depressed), printhead cap 102 is in a capped position with respect to printhead 42.

As illustrated by pictorial 130, at the start of the stroke of user actuated operator 78, and prior to rotation of maintenance assembly 74, priming occurs via vacuum purge unit 110.

As illustrated by pictorial 132, when rotation of maintenance assembly 74 starts, from zero degrees, printhead cap 102 is lifted from the surface of printhead 42 due to the pivot line being outboard of the profile of printhead cap 102. The uncapping operation is completed at about 30 degrees of rotation of maintenance assembly 74.

As illustrated by pictorial 134, at about 90 degrees, printhead wiper 104 engages wet wipe pad 112 to pick up the solvent solution.

As illustrated by pictorial 136, from about 125 degrees to about 180 degrees, printhead wiper 104 wipes printhead 42 with a forward wiping motion. Wiping may occur across the nozzle arrays of printhead 42. Alternatively, wiping may occur parallel to the extent of the nozzle arrays, so as to minimize cross-contamination problems, by simply configuring chassis 72 to receive printhead cartridge 34 oriented sideways, i.e., rotated 90 degrees with respect to its vertical axis from that shown in FIGS. 3 and 4, while maintaining the vertical up orientation of printhead 42. Also, depending on the ink characteristics of the printhead being wiped, the wiping action may be designed to wipe from dye to pigment, or pigment to dye, to further minimize cross-contamination problems, if those types of inks are used.

As illustrated by pictorial 138, from about 180 degrees to about 125 degrees (reverse rotation), printhead wiper 104 wipes printhead 42 with a reverse wiping motion.

As illustrated by pictorial 140, at about 90 degrees (reverse rotation), printhead wiper 104 again engages wet wipe pad 112 to pick up the solvent solution. This is a redundant operation, and helps to remove excess waste ink from printhead wiper 104.

As illustrated by pictorial 142, from about 30 degrees to about 0 degrees (reverse rotation), printhead 42 is recapped by printhead cap 102.

The cycles described above may be repeated, as desired by the user. A final maintenance cycle may be performed just prior to reinsertion of the printhead, such as printhead 42, into printhead carrier 28 to minimize clogs and cross contamination.

The maintenance cycles illustrated in FIG. 7 did not include a printhead spit operation, which is optional, but may be included by the manufacturer, if desired. The printhead spit operation may occur, for example, following the reverse wipe operation. In this case, the position of maintenance assembly 74 may be sensed to initiate the spit operation and/or other auxiliary electrical operations, such as printhead fault detection, printhead resetting, or printhead memory updating.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead garage for receiving an ink jet printhead cartridge when said ink jet printhead cartridge is not installed for use by an imaging apparatus for printing, said ink jet printhead cartridge including a printhead having a plurality of nozzles and a plurality of ink jetting devices, said printhead garage comprising:

a chassis defining an opening for receiving said ink jet printhead cartridge when said ink jet printhead cartridge is not installed for use by said imaging apparatus for printing;

a maintenance assembly coupled to said chassis and configured to perform at least one printhead maintenance operation; and a printhead firing unit coupled to said chassis, said printhead firing unit being electrically connected to said printhead to electrically exercise said plurality of ink jetting devices.

2. The printhead garage of claim 1, wherein said chassis is configured such that said ink jet printhead cartridge is received in said opening oriented with said plurality of nozzles of said printhead in a vertical up position.

3. The printhead garage of claim 2, further comprising a vacuum purge unit to prime said printhead in said vertical up position.

4. The printhead garage of claim 1, comprising:

said maintenance assembly including a printhead capping unit having at least one printhead cap and a printhead wiping unit having at least one printhead wiper;

a user actuated operator; and a toggle cam mechanism coupled between said maintenance assembly and said user actuated operator, wherein when a user applies a force to said user actuated operator, a toggle action of said toggle cam mechanism causes said maintenance assembly to proceed through a predefined printhead maintenance sequence.

5. The printhead garage of claim 4, wherein said maintenance assembly has a pivot line outboard of said at least one printhead cap.

6. The printhead garage of claim 4, wherein said predefined printhead maintenance sequence includes the operation sequence of priming, wiping and reverse wiping of said printhead.

7. The printhead garage of claim 6, wherein following said reverse wiping of said printhead, said printhead is capped by said printhead cap.

8. The printhead garage of claim 6, wherein following said reverse wiping of said printhead, said printhead undergoes a spit operation by electrically exercising said plurality of ink jetting devices.

9. The printhead garage of claim 8, wherein following said spitting operation said printhead is recapped by said printhead cap.

10. The printhead garage of claim 6, wherein when said ink jet printhead cartridge is received in said garage said printhead is initially capped by said printhead cap.

11. The printhead garage of claim 1, wherein said maintenance assembly includes a printhead cap for receiving waste ink purged from said printhead.

12. The printhead garage of claim 11, wherein said waste ink purged from said printhead results from said exercising of said plurality of ink jetting devices.

13. The printhead garage of claim 11, further comprising a vacuum purge unit to prime said printhead, wherein said waste ink purged from said printhead results from priming said printhead.

14. The printhead garage of claim 1, wherein said printhead firing unit performs printhead fault detection.

15. The printhead garage of claim 1, wherein said printhead firing unit updates a total drop count in a memory of said printhead based on said exercising of said plurality of ink jetting devices.

16. A printhead garage for receiving an ink jet printhead cartridge when said ink jet printhead cartridge is not installed for use by an imaging apparatus for printing, said ink jet printhead cartridge including a printhead having a plurality of nozzles and a plurality of ink jetting devices, said printhead garage comprising:

a chassis defining an opening for receiving said ink jet printhead cartridge when said ink jet printhead cartridge is not installed for use by said imaging apparatus for printing;

a maintenance assembly to which a printhead capping unit and a printhead wiping unit are mounted, said printhead capping unit having at least one printhead cap and said printhead wiping unit having at least one printhead wiper;

a user actuated operator; and an actuator mechanism coupled between said maintenance assembly and said user actuated operator, wherein when a user applies a force to said user actuated operator, an action of said actuator mechanism is transferred to said maintenance assembly to cause said maintenance assembly to proceed through a predefined printhead maintenance sequence.

17. The printhead garage of claim 16, said maintenance assembly further including a vacuum purge unit to prime said printhead.

18. The printhead garage of claim 17, wherein said predefined printhead maintenance sequence includes the operation sequence of priming, wiping and reverse wiping of said printhead.

19. The printhead garage of claim 18, wherein when said ink jet printhead cartridge is received in said garage said printhead is capped by said printhead cap.

20. The printhead garage of claim 19, wherein following said reverse wiping of said printhead, said printhead is recapped by said printhead cap.

21. The printhead garage of claim 16, further comprising a printhead firing unit coupled to said chassis, said printhead firing unit being electrically connected to said printhead to electrically exercise said plurality of ink jetting devices during a spit operation.

22. The printhead garage of claim 21, said maintenance assembly further including a priming unit to prime said printhead.

23. The printhead garage of claim 22, wherein said predefined printhead maintenance sequence includes the operation sequence of priming, wiping, reverse wiping, spitting and capping.

24. The printhead garage of claim 16, wherein said chassis is configured such that said ink jet printhead cartridge is received in said opening oriented with said plurality of nozzles of said printhead in a vertical up position.

25. The printhead garage of claim 16, wherein said action is a rotary action.

26. The printhead garage of claim 16, wherein said action is a toggle action.

27. The printhead garage of claim 16, wherein said action is a linear action.

28. A printhead garage comprising a chassis defining an opening for receiving an ink jet printhead cartridge including a printhead having a plurality of nozzles, said opening being configured such that said ink jet printhead cartridge is received with said plurality of nozzles of said printhead in a vertical up position.

29. The printhead garage of claim 28, further comprising:

a printhead cap for capping said printhead; and a vacuum purge unit fluidically coupled to said printhead cap to prime said printhead, with said plurality of nozzles of said printhead oriented in said vertical up position.

* * * * *